US010738608B2

(12) United States Patent
Daher et al.

(10) Patent No.: US 10,738,608 B2
(45) Date of Patent: Aug. 11, 2020

(54) CUTTING DEVICE AND SUPPORT FOR SAME

(71) Applicant: Joy MM Delaware, Inc., Wilmington, DE (US)

(72) Inventors: Nagy Daher, Punchbowl (AU); Richard Boyd, Balgownie (AU); Joaquim Antonio Soares de Sousa, Gauteng (ZA)

(73) Assignee: Joy Global Underground Mining LLC, Warrendale, PA (US)

( * ) Notice: Subject to any disclaimer, the term of this patent is extended or adjusted under 35 U.S.C. 154(b) by 0 days.

(21) Appl. No.: 15/680,765

(22) Filed: Aug. 18, 2017

(65) Prior Publication Data

US 2018/0051561 A1 Feb. 22, 2018

Related U.S. Application Data

(60) Provisional application No. 62/377,150, filed on Aug. 19, 2016, provisional application No. 62/398,834,
(Continued)

(51) Int. Cl.
*E21C 25/06* (2006.01)
*E21C 27/22* (2006.01)
(Continued)

(52) U.S. Cl.
CPC ..... *E21C 27/22* (2013.01); *E21C 25/16* (2013.01); *E21C 25/18* (2013.01); *E21C 27/02* (2013.01);
(Continued)

(58) Field of Classification Search
CPC ..... E21C 27/22
See application file for complete search history.

(56) References Cited

U.S. PATENT DOCUMENTS 1,093,787 A 4/1914 Kuhn et al.
1,735,583 A 11/1929 Morgan
(Continued)

FOREIGN PATENT DOCUMENTS

AU 466244 2/1972
CA 2141984 8/1996
(Continued)

OTHER PUBLICATIONS

International Search Report and Written Opinion for Application No. PCT/US2017/047566 dated Oct. 31, 2017 (13 pages).
(Continued)

*Primary Examiner* — Janine M Kreck
(74) *Attorney, Agent, or Firm* — Michael Best & Friedrich LLP

(57) ABSTRACT

A cutting assembly for a rock excavation machine having a frame includes a boom and a cutting device supported on the boom. The boom includes a first portion and a second portion, the first portion supported for pivotable movement relative to the frame. In some embodiments, the first portion includes a first structure extending along a longitudinal base axis and a second structure moveable relative to the first portion in a direction parallel to the longitudinal base axis, and at least one bearing supports the second portion for movement relative to the first portion. In some embodiments, the second portion is pivotably coupled to the first portion by a universal joint, and a suspension system including a plurality of biasing members may be coupled between the first portion and the second portion.

11 Claims, 14 Drawing Sheets

Related U.S. Application Data filed on Sep. 23, 2016, provisional application No. 62/398,717, filed on Sep. 23, 2016.

(51) Int. Cl.

| | |
|---|---|
| ***E21C 27/02*** | (2006.01) |
| ***E21C 25/18*** | (2006.01) |
| ***E21C 35/20*** | (2006.01) |
| ***E21C 25/16*** | (2006.01) |
| ***E21D 9/10*** | (2006.01) |

(52) U.S. Cl.

CPC ..... *E21C 35/20* (2013.01); *E21D 9/102* (2013.01); *E21D 9/1006* (2013.01)

(56) References Cited

U.S. PATENT DOCUMENTS

| | | | | |
|---|---|---|---|---|
| 1,953,326 | A | 4/1934 | Morgan | |
| 2,517,267 | A | 8/1950 | Watson | |
| 2,619,338 | A | 11/1952 | Lindgren | |
| 2,619,339 | A | 11/1952 | Cartlidge | |
| 2,654,586 | A * | 10/1953 | Berry | E21C 27/22 173/192 |
| 2,659,585 | A | 11/1953 | McCallum | |
| 2,745,651 | A | 5/1956 | Herrmann | |
| 2,776,823 | A | 1/1957 | Barrett | |
| 3,157,437 | A | 11/1964 | Gonski | |
| 3,197,256 | A | 7/1965 | Hlinsky | |
| 3,302,974 | A | 2/1967 | Hlinsky | |
| 3,353,871 | A | 11/1967 | Arentzen | |
| 3,412,816 | A | 11/1968 | Lautsch | |
| 3,446,535 | A | 5/1969 | Lauber | |
| 3,647,263 | A | 3/1972 | Lauber et al. | |
| 3,663,054 | A | 5/1972 | Dubois | |
| 3,719,404 | A * | 3/1973 | Sterner | B66C 23/707 384/38 |
| 3,729,056 | A | 4/1973 | Paurat | |
| 3,840,271 | A | 10/1974 | Sugden | |
| 3,922,017 | A | 11/1975 | Cobb | |
| 3,972,571 | A * | 8/1976 | Benkowski | B66C 23/707 384/42 |
| 3,995,907 | A | 12/1976 | Dubois | |
| 4,005,905 | A | 2/1977 | Dubois | |
| 4,087,131 | A | 5/1978 | Peterson et al. | |
| 4,108,494 | A | 8/1978 | Kogler | |
| 4,230,372 | A * | 10/1980 | Marten | E02F 3/188 173/195 |
| 4,248,481 | A | 2/1981 | Stoltefuss | |
| 4,273,383 | A | 6/1981 | Grisebach | |
| 4,302,054 | A | 11/1981 | Haskew et al. | |
| 4,377,311 | A | 3/1983 | Seller | |
| 4,470,635 | A * | 9/1984 | Paurat | E21D 9/102 173/4 |
| 4,516,807 | A | 5/1985 | Eagles | |
| 4,589,701 | A | 5/1986 | Beckmann et al. | |
| 4,643,483 | A | 2/1987 | Brooks et al. | |
| 4,647,112 | A | 3/1987 | Demoulin et al. | |
| 4,662,684 | A | 5/1987 | Marten | |
| 4,682,819 | A | 7/1987 | Masse | |
| 4,755,002 | A | 7/1988 | Parrott | |
| 4,760,513 | A | 7/1988 | Edwards | |
| 4,796,713 | A | 1/1989 | Bechem | |
| 4,838,614 | A | 6/1989 | Pentith et al. | |
| 4,838,615 | A | 6/1989 | Oldham | |
| 5,028,092 | A | 7/1991 | Coski | |
| 5,087,102 | A | 2/1992 | Kiefer | |
| 5,190,353 | A | 3/1993 | Bechem | |
| 5,205,612 | A | 4/1993 | Sugden et al. | |
| 5,210,997 | A | 5/1993 | Mountcastle, Jr. | |
| 5,601,153 | A | 2/1997 | Ensminger et al. | |
| 5,676,125 | A | 10/1997 | Kelly et al. | |
| 5,697,733 | A | 12/1997 | Marsh | |
| 5,938,288 | A | 8/1999 | Saint-Pierre et al. | |
| 6,086,257 | A * | 7/2000 | Lee | F16C 33/10 384/129 |
| 6,561,590 | B2 | 5/2003 | Sugden | |
| 6,857,706 | B2 | 2/2005 | Hames et al. | |
| 7,182,407 | B1 * | 2/2007 | Peach | E21C 25/16 299/75 |
| 7,325,882 | B2 | 2/2008 | Sugden et al. | |
| 7,384,104 | B2 | 6/2008 | Sugden | |
| 7,431,402 | B2 | 10/2008 | Peach et al. | |
| 7,490,911 | B2 | 2/2009 | Steinberg et al. | |
| 7,695,071 | B2 | 4/2010 | Jackson et al. | |
| 7,934,776 | B2 | 5/2011 | de Andrade et al. | |
| 8,079,647 | B2 | 12/2011 | Yao et al. | |
| 8,328,292 | B2 | 12/2012 | de Andrade et al. | |
| 8,636,324 | B2 | 1/2014 | Skea | |
| 8,727,450 | B2 | 5/2014 | de Andrade et al. | |
| 9,470,087 | B2 | 10/2016 | Smith et al. | |
| 2002/0093239 | A1 | 7/2002 | Sugden | |
| 2005/0200192 | A1 | 9/2005 | Sugden et al. | |
| 2007/0090678 | A1 | 4/2007 | Peach et al. | |
| 2007/0193810 | A1 | 8/2007 | Steinberg et al. | |
| 2008/0156531 | A1 | 7/2008 | Boone et al. | |
| 2009/0058172 | A1 | 3/2009 | DeAndrade et al. | |
| 2009/0066148 | A1 | 3/2009 | Willison | |
| 2009/0127918 | A1 | 5/2009 | Yao et al. | |
| 2010/0260563 | A1 | 10/2010 | Conroy et al. | |
| 2011/0062768 | A1 | 3/2011 | Van Zyl et al. | |
| 2011/0181097 | A1 | 7/2011 | Skea | |
| 2012/0098325 | A1 | 4/2012 | Junker et al. | |
| 2013/0057044 | A1 | 3/2013 | De Andrade et al. | |
| 2014/0077578 | A1 * | 3/2014 | Smith | E21C 25/06 299/1.4 |
| 2014/0091612 | A1 | 4/2014 | Rowher et al. | |
| 2015/0152728 | A1 | 6/2015 | Hartwig et al. | |

FOREIGN PATENT DOCUMENTS

| | | | |
|---|---|---|---|
| CL | 35975 | | 9/1987 |
| CL | 200901978 | | 2/2010 |
| CN | 101778998 | A | 7/2010 |
| CN | 101828004 | A | 9/2010 |
| CN | 102061914 | A | 5/2011 |
| CN | 102305067 | A | 1/2012 |
| CN | 102587911 | | 7/2012 |
| CN | 102606154 | A | 7/2012 |
| CN | 10204927 | | 10/2012 |
| CN | 102733803 | | 10/2012 |
| CN | 202500560 | U | 10/2012 |
| CN | 103206213 | A | 7/2013 |
| CN | 103498671 | A | 1/2014 |
| DE | 4123307 | C1 | 12/1992 |
| DE | 4440261 | | 5/1996 |
| DE | 19900906 | A1 | 7/2000 |
| EP | 0176234 | A1 | 4/1986 |
| EP | 0329915 | A1 | 8/1989 |
| JP | S5540058 | U | 3/1980 |
| RU | 2187640 | C1 | 8/2002 |
| RU | 2209979 | C2 | 8/2003 |
| RU | 2276728 | C1 | 5/2006 |
| RU | 2441155 | C1 | 1/2012 |
| SU | 323552 | A | 11/1972 |
| SU | 581263 | | 11/1977 |
| SU | 619117 | | 8/1978 |
| SU | 150061 | | 7/1980 |
| SU | 962626 | | 9/1982 |
| SU | 1328521 | | 8/1987 |
| SU | 1731946 | | 5/1992 |
| SU | 1744249 | A1 | 6/1992 |
| WO | WO0043637 | | 7/2000 |
| WO | WO0046486 | | 8/2000 |
| WO | WO0201045 | | 1/2002 |
| WO | WO02066793 | | 8/2002 |
| WO | 2003062587 | | 7/2003 |
| WO | WO03089761 | | 10/2003 |

OTHER PUBLICATIONS

International Mining, "DynaCut Technology Achieving Breakthroughs," <https://im-mining.com/2015/12/17/dynacut-technology-achieving-breakthroughs/> web page accessed Nov. 22, 2019.

(56) References Cited

OTHER PUBLICATIONS

Mining3 Mining, "CRCMining Joy Global Oscillating Disc Cutter (ODC) Hard Rock Cutting Machine," <https://www.youtube.com/watch?v=anyPQWkH4rM> web page accessed Oct. 24, 2019.
Chilean Patent Office Search Report and Examiner's Report for Application No. 201900450 dated Mar. 6, 2020 (18 pages including statement of relevance).

* cited by examiner

CUTTING DEVICE AND SUPPORT FOR SAME

CROSS-REFERENCE TO RELATED APPLICATION

This application claims the benefit of prior-filed, U.S. Provisional Patent Application No. 62/377,150, filed Aug. 19, 2016, U.S. Provisional Patent Application No. 62/398,834, filed Sep. 23, 2016, and U.S. Provisional Patent Application No. 62/398,717, filed Sep. 23, 2016. The entire contents of these documents are incorporated by reference herein.

BACKGROUND

The present disclosure relates to mining and excavation machines, and in particular to a cutting device for a mining or excavation machine.

Hard rock mining and excavation typically requires imparting large energy on a portion of a rock face in order to induce fracturing of the rock. One conventional technique includes operating a cutting head having multiple mining picks. Due to the hardness of the rock, the picks must be replaced frequently, resulting in extensive down time of the machine and mining operation. Another technique includes drilling multiple holes into a rock face, inserting explosive devices into the holes, and detonating the devices. The explosive forces fracture the rock, and the rock remains are then removed and the rock face is prepared for another drilling operation. This technique is time-consuming and exposes operators to significant risk of injury due to the use of explosives and the weakening of the surrounding rock structure. Yet another technique utilizes roller cutting element(s) that rolls or rotates about an axis that is parallel to the rock face, imparting large forces onto the rock to cause fracturing.

SUMMARY

In one aspect, a cutting assembly for a rock excavation machine having a frame includes a boom and a cutting device. The boom includes a first portion and a second portion. The first portion is configured to be supported by the frame, and the second portion pivotably coupled to the first portion by a universal joint. The cutting device supported by the second portion of the boom.

In another aspect, a cutting assembly for a rock excavation machine having a frame includes a boom, at least one bearing, and a cutting device. The boom includes a first portion and a second portion. The first portion is supported for pivotable movement relative to the frame, and the first portion extends along a longitudinal base axis. The second portion is coupled to the first portion and is moveable relative to the first portion in a direction parallel to the longitudinal base axis. The at least one bearing supports the second portion for movement relative to the first portion. Each bearing includes a main support and a pad. The main support is secured to the first portion, and the pad abuts a surface of the second portion. The cutting device is supported by the second portion of the boom.

In yet another aspect, a cutting assembly for a rock excavation machine having a frame includes a boom, a suspension system, at least one bearing, and a cutting device. The boom includes a first portion and a second portion. The first portion is supported for pivotable movement relative to the frame, and the first portion includes a first structure extending along a longitudinal base axis and a second structure moveable relative to the first portion in a direction parallel to the longitudinal base axis. The second portion is pivotably coupled to the first portion by a universal joint. The suspension system includes a plurality of biasing members coupled between the first portion and the second portion. The at least one bearing supports the second portion for movement relative to the first portion. Each bearing includes a main support and a pad. The main support is secured to the first portion, and the pad abuts a surface of the second portion. The cutting device is supported by the second portion of the boom.

In some aspects, the boom includes a first portion includes a first structure and a second structure pivotably coupled to the first structure, the first structure pivotable about a first axis between a raised position and a lowered position, the second structure directly coupled to the universal joint and pivotable about a second axis relative to the first structure between a raised position and a lowered position.

In still another aspect, a cutting assembly for a rock excavation machine having a frame includes a boom and a cutting device. The boom includes a first member and a second member pivotably coupled to the first member. The first member is pivotable about a first axis between a raised position and a lowered position, and the second member is pivotable about a second axis relative to the first member between a raised position and a lowered position. The second axis is parallel to the first axis. The cutting device is supported by the second member.

In some aspects, the boom includes a universal joint supporting the cutting device relative to the second member, the universal joint including a first shaft extending along a first joint axis, the universal joint further including a second shaft extending along a second joint axis and pivotably coupled to the first shaft to permit pivoting movement about the first joint axis and about the second joint axis.

In some aspects, the cutting assembly further includes a plurality of biasing members spaced apart about the universal joint, the biasing members extending between the second member and the cutting device.

In some embodiments, the cutting device includes a cutting disc and an excitation device, the cutting disc having a cutting edge positioned in a cutting plane, the excitation device including an eccentric mass supported for rotation in an eccentric manner and positioned proximate the cutting disc, wherein rotation of the eccentric mass induces oscillation of the cutting device.

Other aspects will become apparent by consideration of the detailed description and accompanying drawings.

DETAILED DESCRIPTION

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect. Also, electronic communications and notifications may be performed using any known means including direct connections, wireless connections, etc.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, aspects of the invention may be implemented in software (for example, stored on non-transitory computer-readable medium) executable by one or more processing units, such as a microprocessor, an application specific integrated circuits ("ASICs"), or another electronic device. As such, it should be noted that a plurality of hardware and software based devices, as well as a plurality of different structural components may be utilized to implement the invention. For example, "controllers" described in the specification may include one or more electronic processors or processing units, one or more computer-readable medium modules, one or more input/output interfaces, and various connections (for example, a system bus) connecting the components.

Figure 1:
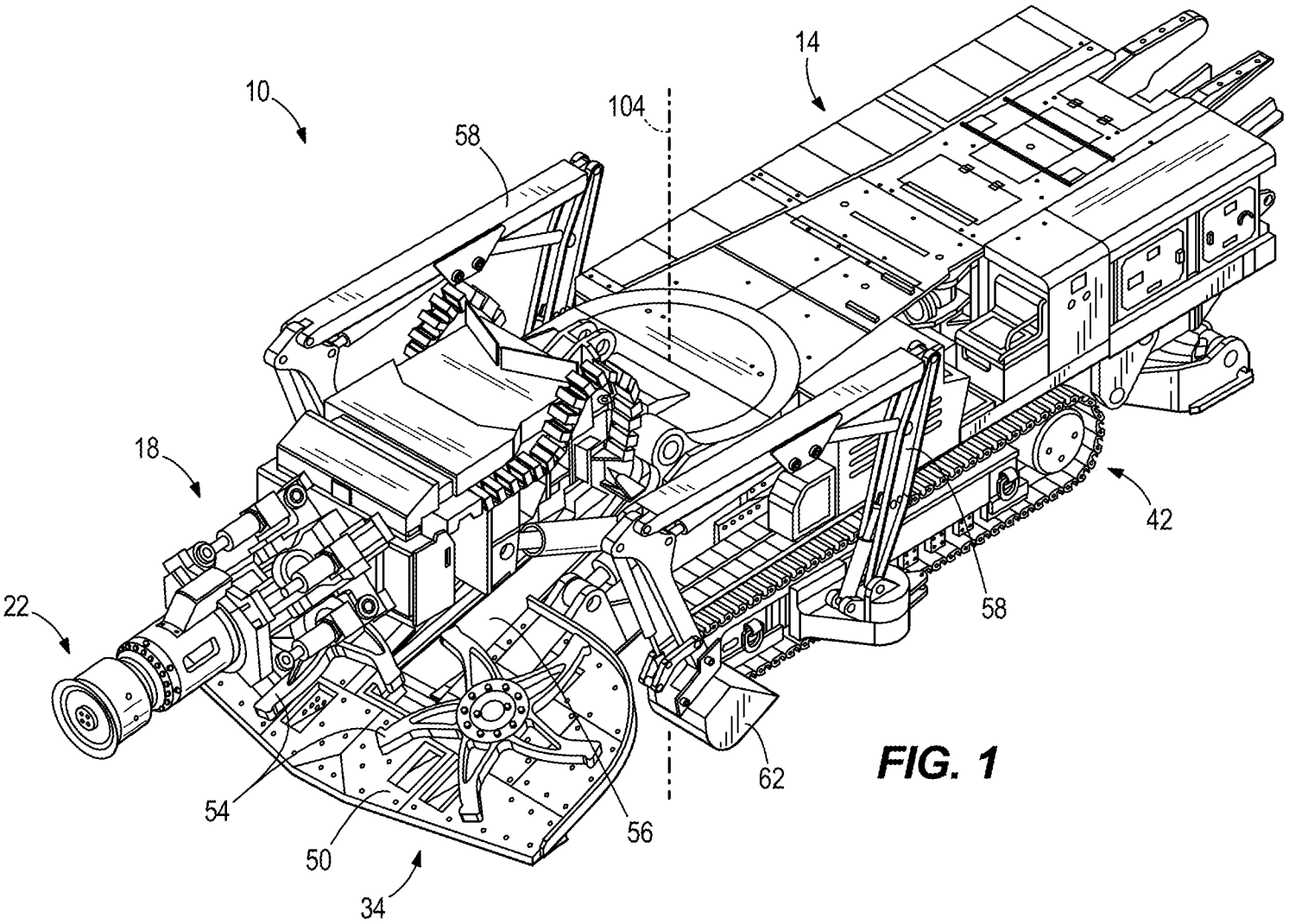
FIG. 1 is a perspective view of an excavation machine.
Figure 2:
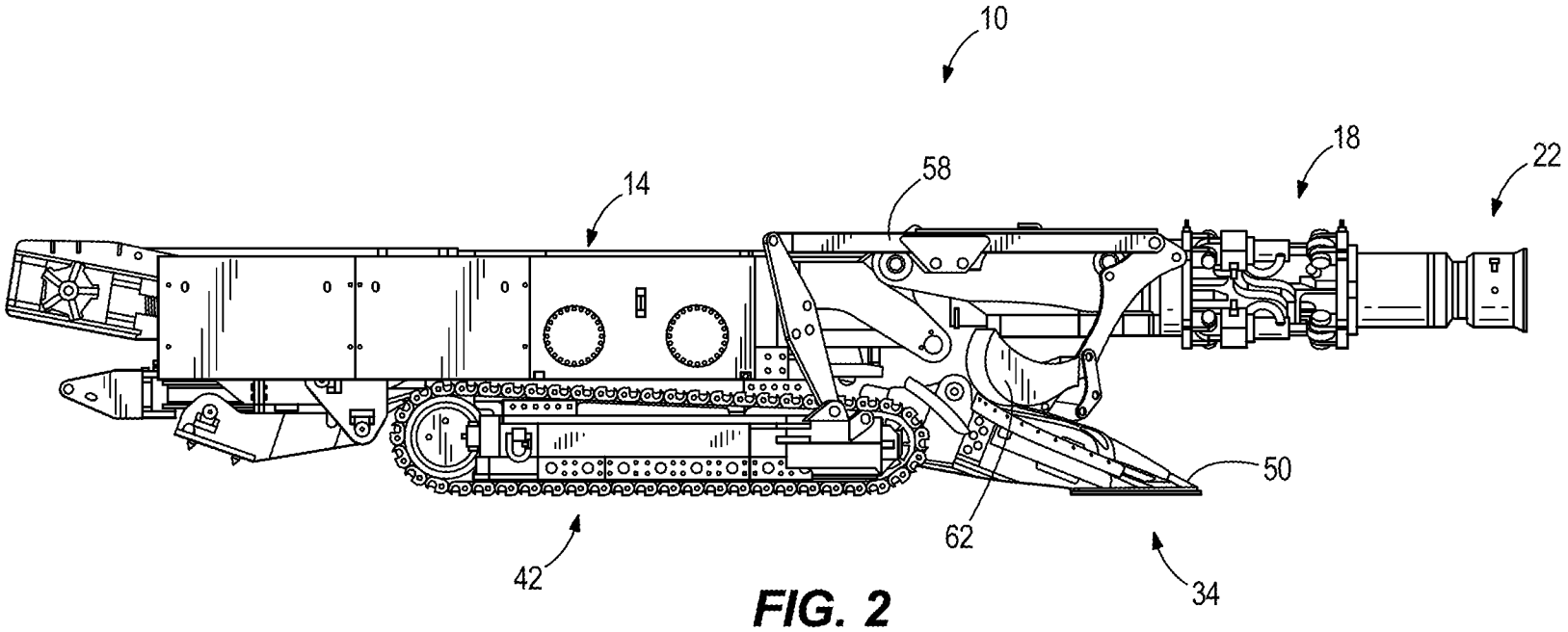
FIG. 2 is side view of the excavation machine of FIG. 1.

FIGS. 1 and 2 illustrate an excavation machine or mining machine 10 including a chassis 14, a boom 18, a cutting head or cutting device 22 for engaging a rock face 30 (FIG. 4), and a material gathering head or gathering device 34. In the illustrated embodiment, the chassis 14 is supported on a crawler mechanism 42 for movement relative to a floor (not shown). The gathering device 34 includes a deck 50 and rotating arms 54. As the machine 10 advances, the cut material is urged onto the deck 50, and the rotating arms 54 move the cut material onto a conveyor 56 (FIG. 1) for transporting the material to a rear end of the machine 10. In other embodiments, the arms 54 may slide or wipe across a portion of the deck 50 (rather than rotating) to direct cut material onto the conveyor 56. Furthermore, in some embodiments, the gathering device 34 may also include a pair of articulated arms 58, each of which supports a bucket 62. The articulated arms 58 and buckets 62 may remove material from an area in front of the machine 10 and may direct the material onto the deck 50.

Figure 3:
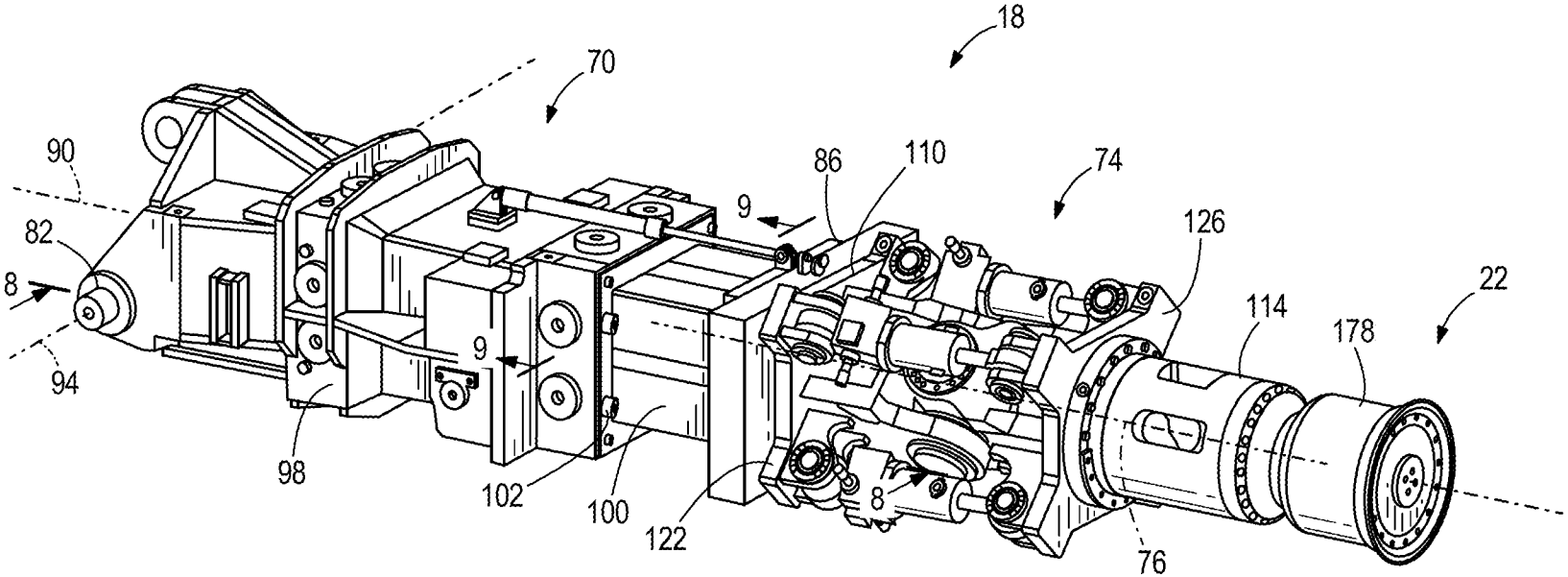
FIG. 3 is a perspective view of a boom and a cutting device.

As shown in FIG. 3, the boom 18 supports the cutting device 22. The boom 18 includes a first portion or base portion 70 and a second portion or wrist portion 74 supporting the cutting device 22. The base portion 70 includes a first end 82 coupled to the chassis 14 (FIG. 2) and a second end 86, and the base portion 70 defines a base axis 90 extending between the first end 82 and the second end 86. In one embodiment, the first end 82 is pivotable relative to the chassis 14 about a transverse axis 94 oriented perpendicular to the base axis 90. The transverse axis 94 may be offset from the base axis 90 such that the transverse axis 94 and base axis 90 do not intersect. In the illustrated embodiment, the boom 18 is formed as a first structure 98 proximate the first end 82 and a second structure 100 proximate the second end 86. The first structure 98 is pivotable and includes an opening 102 receiving the second structure 100 in an extendable or telescoping manner. The first structure 98 is pivotable about the transverse axis 94 and may also be pivoted laterally about a vertical axis or slew axis 104 (FIG. 1) (e.g., by rotation of a turntable coupling).

The wrist portion 74 is coupled to the movable structure 100 and supported relative to the base portion 70. The wrist portion 74 may move or telescope with the second end 86 of the base portion 70, thereby selectively extending and retracting the wrist portion 74 in a direction parallel to the base axis 90. In the illustrated embodiment, the second end 86 is extended and retracted by operation of one or more fluid actuators 164 (e.g., hydraulic cylinders—FIG. 8). The wrist portion 74 includes a first end 110 and a second end 114 and defines a wrist axis 76. In some embodiments, when the wrist portion 74 is in a rest position, the wrist axis 76 may be oriented substantially parallel to the base axis 90. The first end 110 of the wrist portion 74 is supported by the second end 86 of the base portion 70. The cutting device 22 is coupled to the second end 114 of the wrist portion 74.

Figure 4:
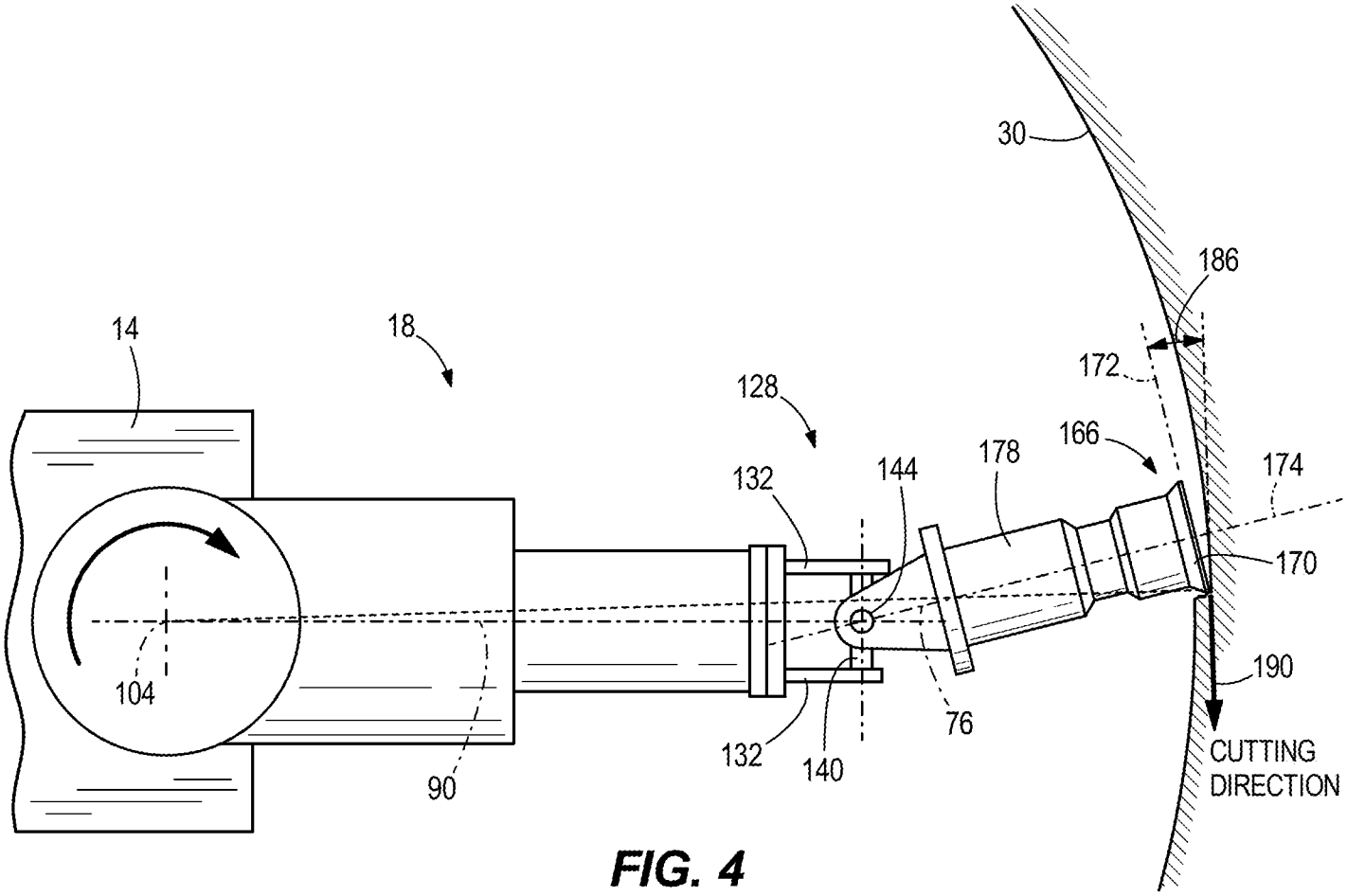
FIG. 4 is a top view of a boom and a cutting device engaging a rock face.

Referring to FIG. 4, the cutting device 22 includes a cutting bit or cutting disc 166 having a peripheral edge 170, and a plurality of cutting bits 156 (FIG. 6) positioned along the peripheral edge 170. The peripheral edge 170 defines a cutting plane 172, and the cutting disc 166 rotates about a cutter axis 174 (FIG. 4).

Figure 5:
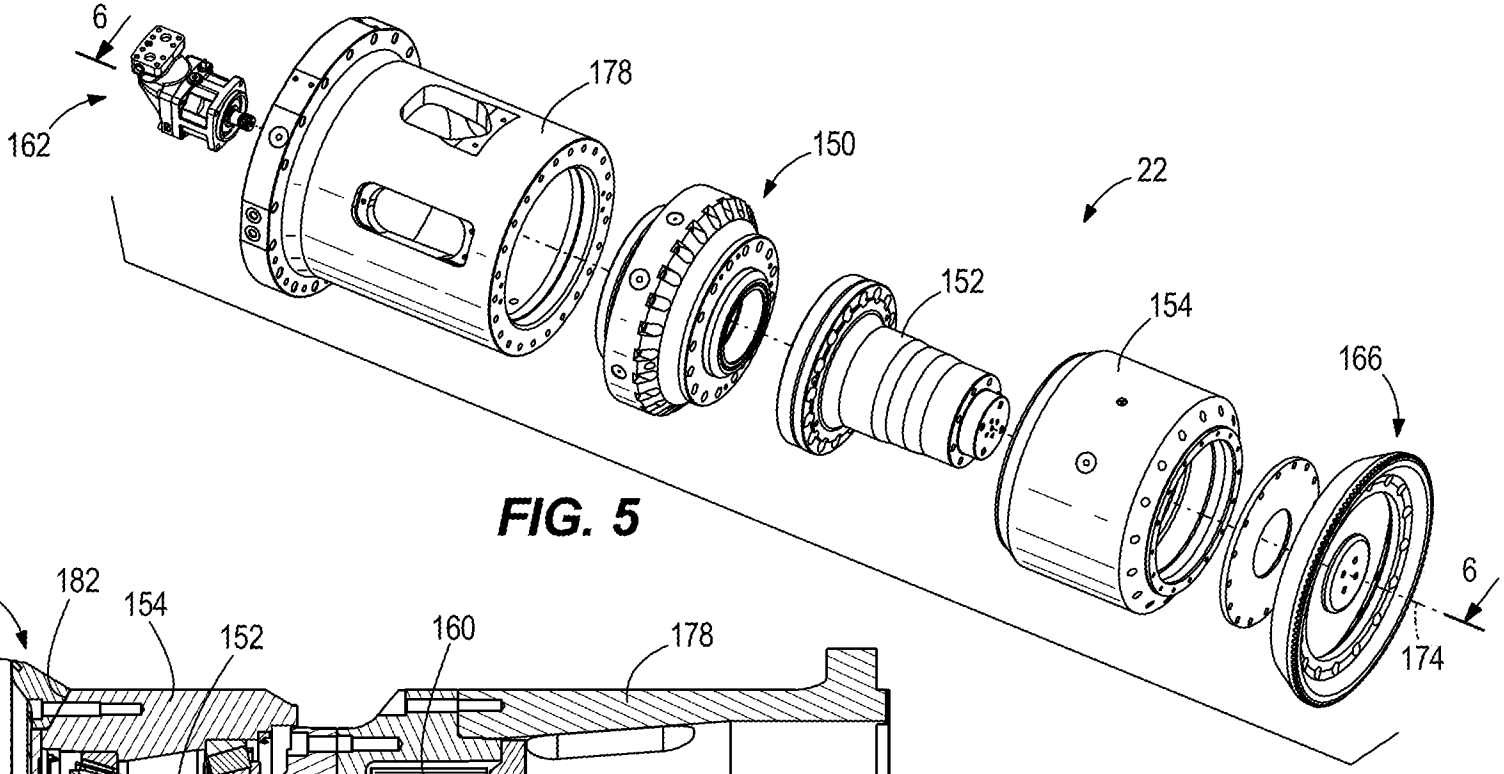
FIG. 5 is an exploded view of a cutting device.
Figure 6:
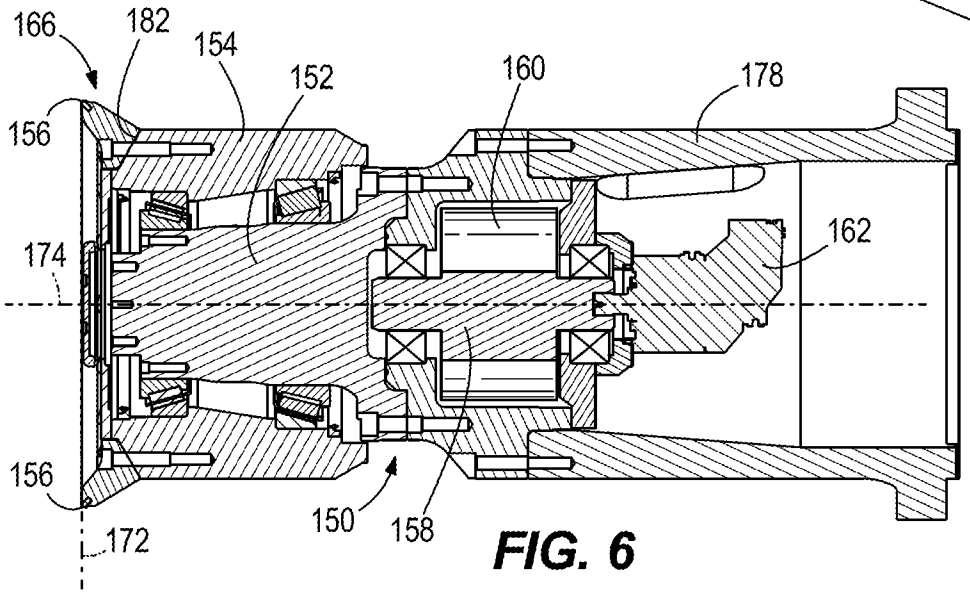
FIG. 6 is a section view of the cutting device of FIG. 5 viewed along section 6-6.

As shown in FIGS. 5 and 6, in the illustrated embodiment, the cutting device 22 further includes a housing 178, an excitation element 150, and a shaft 152 removably coupled (e.g., by fasteners) to the excitation element 150. The cutting disc 166 is coupled (e.g., via fasteners) to a carrier 154 that is supported on an end of the shaft 152 for rotation (e.g., by roller bearings) about the cutter axis 174. In the illustrated embodiment, the cutting disc 166 engages the carrier 154 along an inclined surface 182 forming an acute angle relative to the cutting plane 172. Defined another way, the cutting disc 166 abuts a surface 182 tapering inwardly toward the cutter axis 174 in a direction oriented away from the housing 178. In some embodiments, the cutting disc 166 is supported for free rotation relative to the housing 178 (i.e., the cutting disc 166 is neither prevented from rotating nor positively driven to rotate except by induced oscillation).

In the illustrated embodiment, the end of the shaft 152 is formed as a stub or cantilevered shaft generally extending parallel to the cutter axis 174. The excitation element 150 may include an exciter shaft 158 and an eccentric mass 160 secured to the exciter shaft 158 for rotation with the exciter shaft 158. The exciter shaft 158 is driven by a motor 162 and is supported for rotation (e.g., by roller bearings). The rotation of the eccentric mass 160 induces an eccentric oscillation in the shaft 152, thereby inducing oscillation of the cutting disc 166. In some embodiments, the structure of the cutting device 22 and excitation element 150 may be similar to the cutter head and excitation element described in U.S. patent application Ser. No. 15/418,490, filed Jan. 27, 2016, the entire contents of which are hereby incorporated by reference. In other embodiments, the cutting device 22 and excitation element 150 may be similar to the exciter member and cutting bit described in U.S. Publication No. 2014/0077578, published Mar. 20, 2014, the entire contents of which are hereby incorporated by reference.

Referring again to FIG. 4, in the illustrated embodiment, the cutter axis 174 is oriented at an angle 186 relative to a tangent of the rock face 30 at a contact point with the cutting disc 166. In some embodiments, the angle 186 is between approximately 0 degrees and approximately 25 degrees. In some embodiments, the angle 186 is between approximately 1 degree and approximately 10 degrees. In some embodiments, the angle 186 is between approximately 3 degrees and approximately 7 degrees. In some embodiments, the angle 186 is approximately 5 degrees.

The cutting device 22 engages the rock face 30 by undercutting the rock face 30. That is, a leading edge of the cutting disc 166 engages the rock face 30 such that the cutting disc 166 (e.g., the cutting plane 172) forms a low or small angle relative to the rock face 30 and traverses across a length of the rock face 30 in a cutting direction 190. Orienting the cutting disc 166 at an angle provides clearance between the rock face 30 and a trailing edge of the cutting disc 166 (i.e., a portion of the edge that is positioned behind the leading edge with respect to the cutting direction 190).

Figure 7:
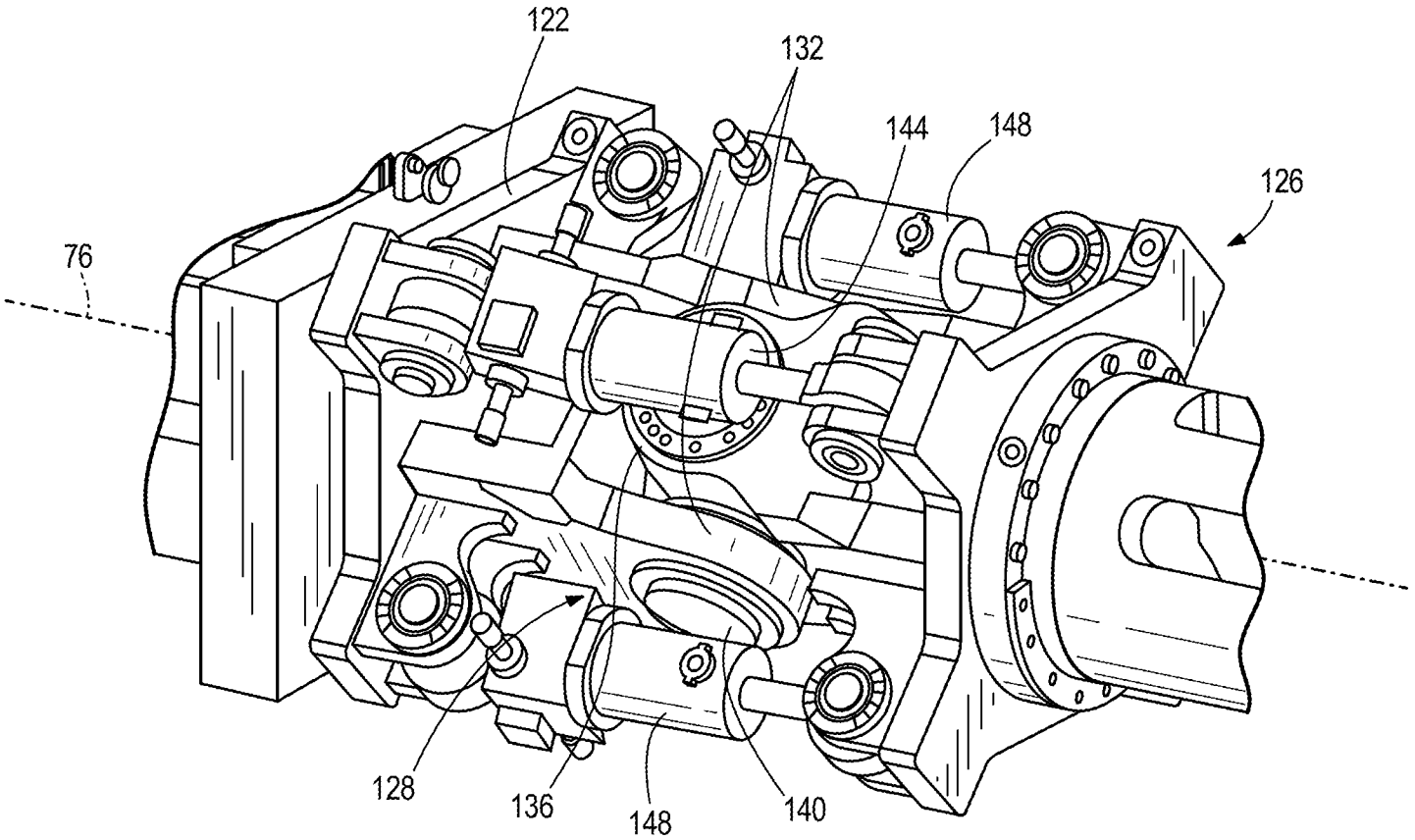
FIG. 7 is an enlarged perspective view of a wrist portion of the boom of FIG. 3.
Figure 7A:
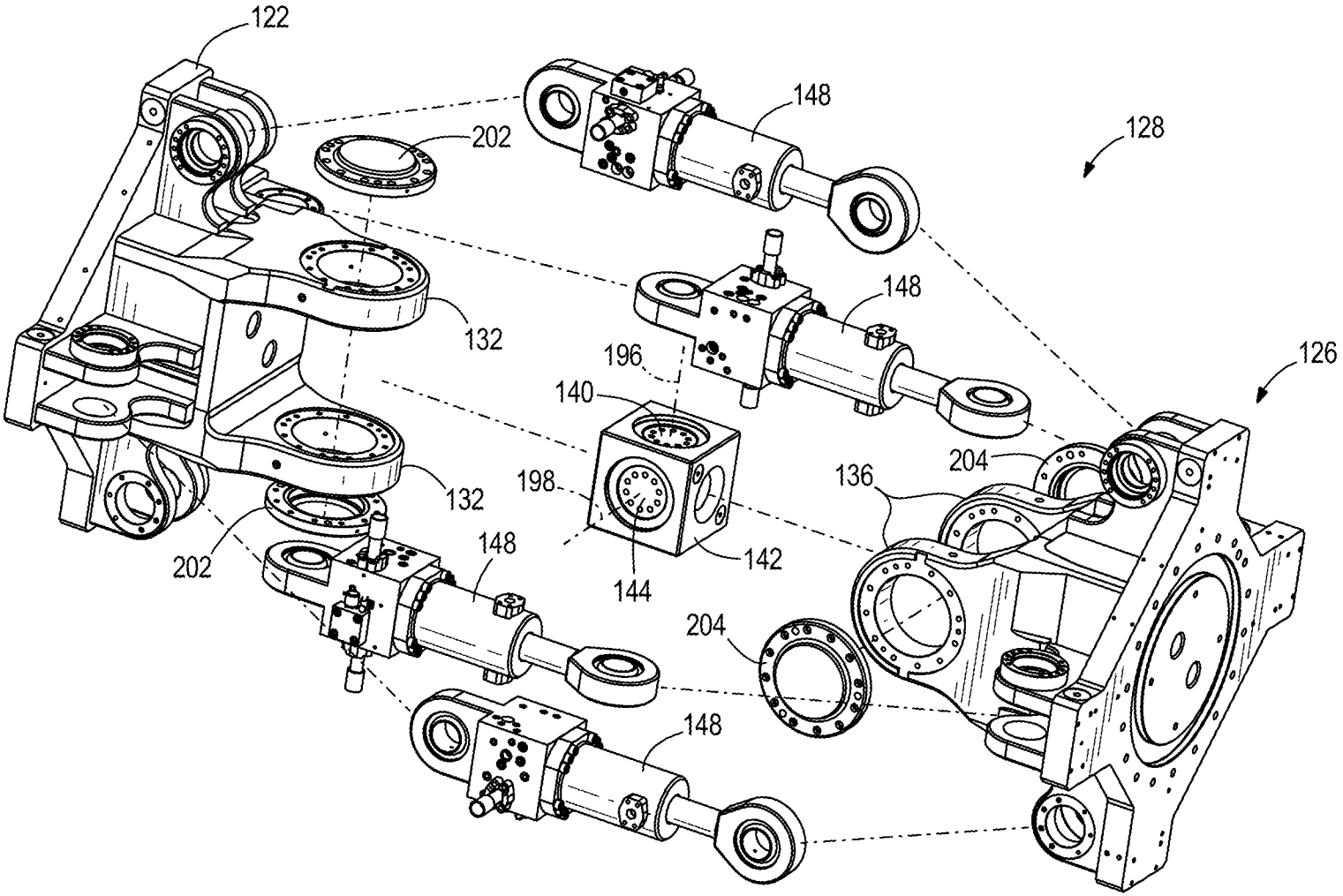
FIG. 7A is an exploded view of the wrist portion of FIG. 7.

Referring to FIG. 7, the wrist portion 74 includes a universal joint or U-joint 128 coupling the first member 122 and the second member 126. In particular, the first member 122 includes a pair of parallel first lugs 132 and the second member 126 includes a pair of parallel second lugs 136. A first shaft 140 is positioned between the first lugs 132 and a second shaft 144 is positioned between the second lugs 136 and is coupled to the first shaft 140. In some embodiments, the second shaft 144 is rigidly coupled to the first shaft 140. In the illustrated embodiment, the first shaft 140 and second shaft 144 are positioned in a support member 142 and are supported for rotation relative to the lugs 132, 136 by bearings 202, 204, respectively. The first shaft 140 defines a first axis 196 that is substantially perpendicular to the wrist axis 76, and the second shaft 144 defines a second axis 198. In the illustrated embodiment, the second axis 198 is substantially perpendicular to the cutter axis 174. The first axis 196 and the second axis 198 are oriented perpendicular to each other. The universal joint 128 allows the second member 126 to pivot relative to the first member 122 about the first axis 196 and the second axis 198. Other aspects of universal joints are understood by a person of ordinary skill in the art and are not discussed in further detail. Among other things, the incorporation of a universal joint permits the cutting device 22 to precess about the axes of the universal joint, and the joint is capable of transferring shear and torque loads.

The wrist portion 74 further includes a suspension system for controlling movement of the second member 126 relative to the first member 122. In the illustrated embodiment, the suspension system includes multiple fluid cylinders 148 (e.g., hydraulic cylinders). The fluid cylinders 148 maintain a desired offset angle between the first member 122 and the second member 126. The fluid cylinders 148 act similar to springs and counteract the reaction forces exerted on the cutting device 22 by the rock face 30.

In the illustrated embodiment, the suspension system includes four fluid cylinders 148 spaced apart from one another about the wrist axis 76 by an angular interval of approximately ninety degrees. The cylinders 148 extend in a direction that is generally parallel to the wrist axis 76, but the cylinders 148 are positioned proximate the end of each of the first shaft 140 and the second shaft 144. Each fluid cylinders 148 includes a first end coupled to the first member 122 and a second end coupled to the second member 126. The ends of each cylinder 148 may be connected to the first member 122 and the second member 126 by spherical couplings to permit pivoting movement. The suspension system transfers the cutting force as a moment across the universal joint 128, and controls the stiffness between the wrist portion 74 and the base portion 70.

Figure 11:
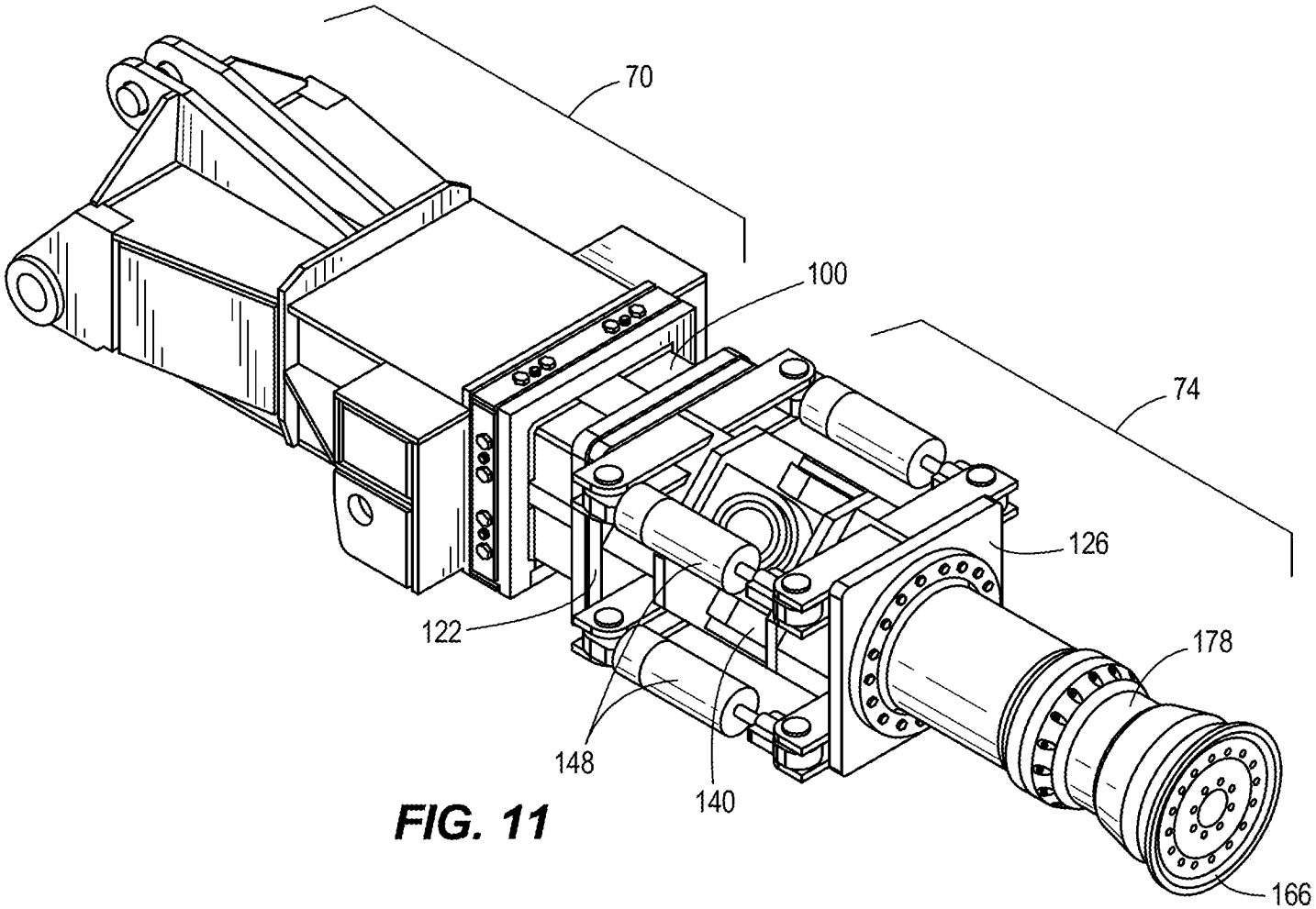
FIG. 11 is a perspective view of a boom and a cutting device according to another embodiment.

In other embodiments, the suspension system may include fewer or more fluid actuators 148. The fluid actuators 148 may be positioned in a different configuration between the first member 122 and the second member 126 (e.g., see FIG. 11, in which the hydraulic cylinders 148 are offset from the axes of the shafts 140, 144; stated another way, each cylinder 148 may extend between a corner of the first member 122 and a corresponding corner of the second member 126). In still other embodiments, the suspension system may incorporate one or more mechanical spring element(s), either instead of or in addition to the fluid cylinders 148.

Figure 12:
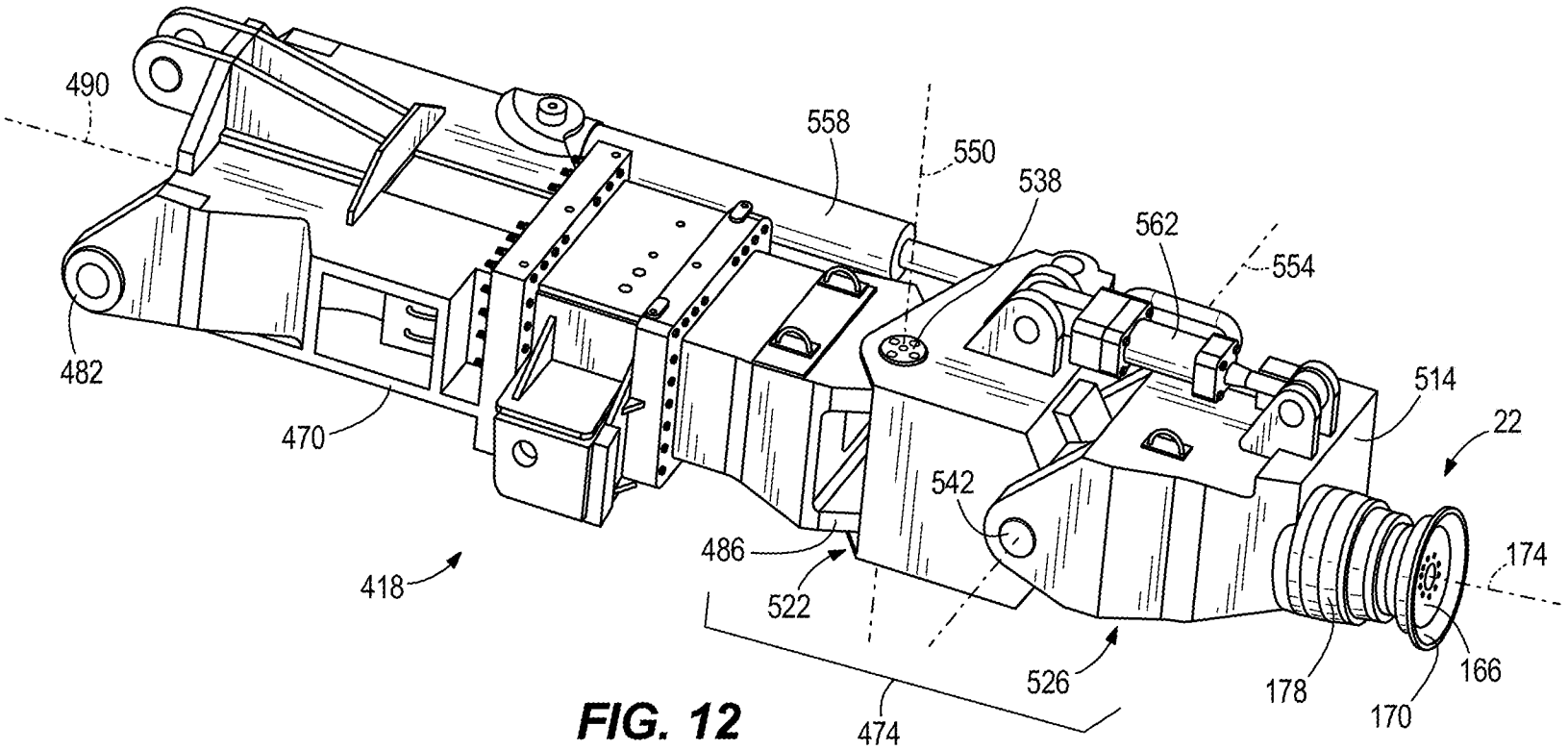
FIG. 12 is a perspective view of a boom and a cutting device according to another embodiment.

FIG. 12 shows another embodiment of the boom 418 including a wrist portion 474. For brevity, only differences are discussed, and similar features are identified with similar reference numbers, plus 400. The wrist portion 474 may include a first member 522 that pivots about a first pivot pin 538 and a second member 526 that pivots about a second pivot pin 542 that is offset from the first pivot pin 538. The first member 522 and the second member 526 may pivot about perpendicular, offset axes. The first member 522 forms a first end of the wrist portion 474. The second member 526 forms the second end 514 of the wrist portion 474 and supports the cutting device 22.

The first member 522 is coupled to the base portion 470 by the first pivot pin 538, and the second member 526 is coupled to the first member 522 by the second pivot pin 542. In the illustrated embodiment, the first pivot pin 538 provides a first pivot axis 550 oriented perpendicular to the base axis 490 and permits the first member 522 to pivot relative to the base portion 470 in a plane containing axis 490. The second pivot pin 542 provides a second pivot axis 554 oriented transverse to the base axis 490 and perpendicular to the first pivot axis 550, permitting the second member 526 to pivot relative to the first member 522 in a vertical plane. The first member 522 is pivoted about the first pivot axis 550 by actuation of a first actuator 558, and the second member 526 is pivoted about the second pivot axis 554 by actuation of a second actuator 562.

Figure 13:
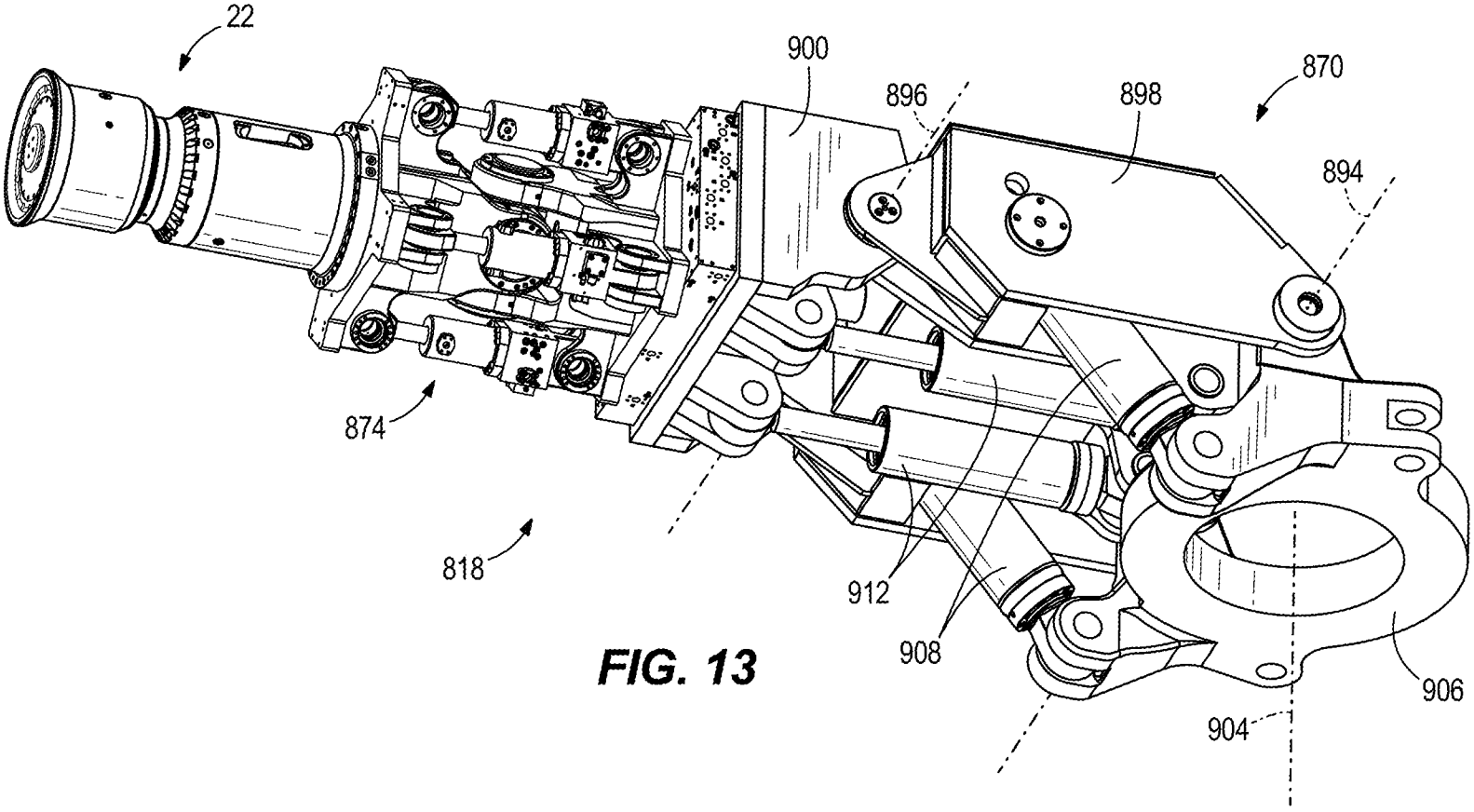
FIG. 13 is a perspective view of a boom and cutting device according to another embodiment.
Figure 14:
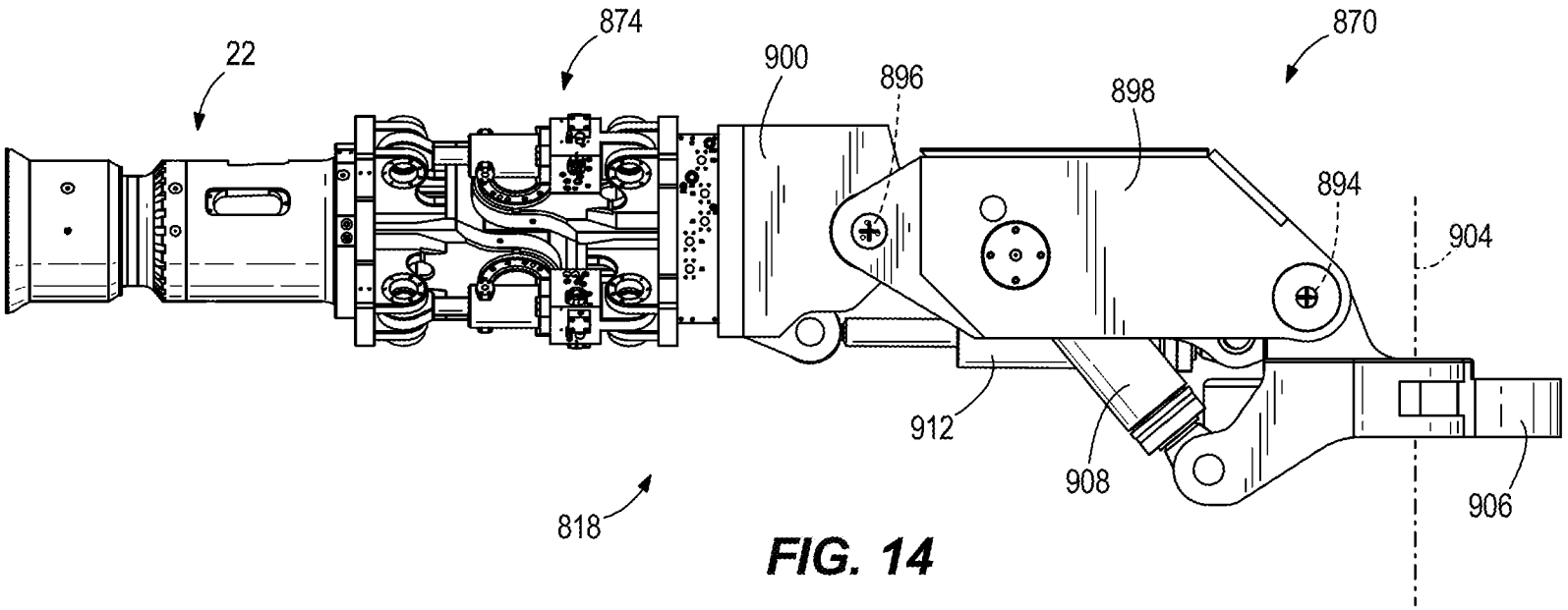
FIG. 14 is a side view of the boom and cutting device of FIG. 13.

FIGS. 13 and 14 shows another embodiment of the boom 818 including a wrist portion 874 supported by multiple articulating boom portions. In particular, a base portion 870 of the boom 818 includes a first member or first structure 898 and a second member or second structure 900 pivotably coupled to the first structure 898. In the illustrated embodiment, the first structure 898 is supported on a slew coupling 906 for pivoting the boom 818 in a lateral plane about a slew axis 904. The first structure 898 is pivotable relative to the slew coupling 906 about a first axis 894 oriented transverse to the slew axis 904, and the second structure 900 is pivotable relative to the first structure 898 about a second axis 896 oriented parallel to the first axis 894. The slew coupling 906 may be driven to pivot by actuators (e.g., hydraulic cylinders—not shown). The first structure 898 is driven to pivot about the first axis 894 by first actuators 908, and the second structure 900 is driven to pivot about the second axis 896 by second actuators 912. The first axis 894 and second axis 896 both extend in a transverse orientation, thereby providing two independently articulating luff portions to provide significant versatility for pivoting the cutting device in a vertical plane. In other embodiments, the first structure and second structure may pivot in a different manner. The wrist portion 874 is secured to an end of the second structure 900 distal from the first structure 898, and the cutting device 22 is supported by the wrist portion 874.

Figure 8:
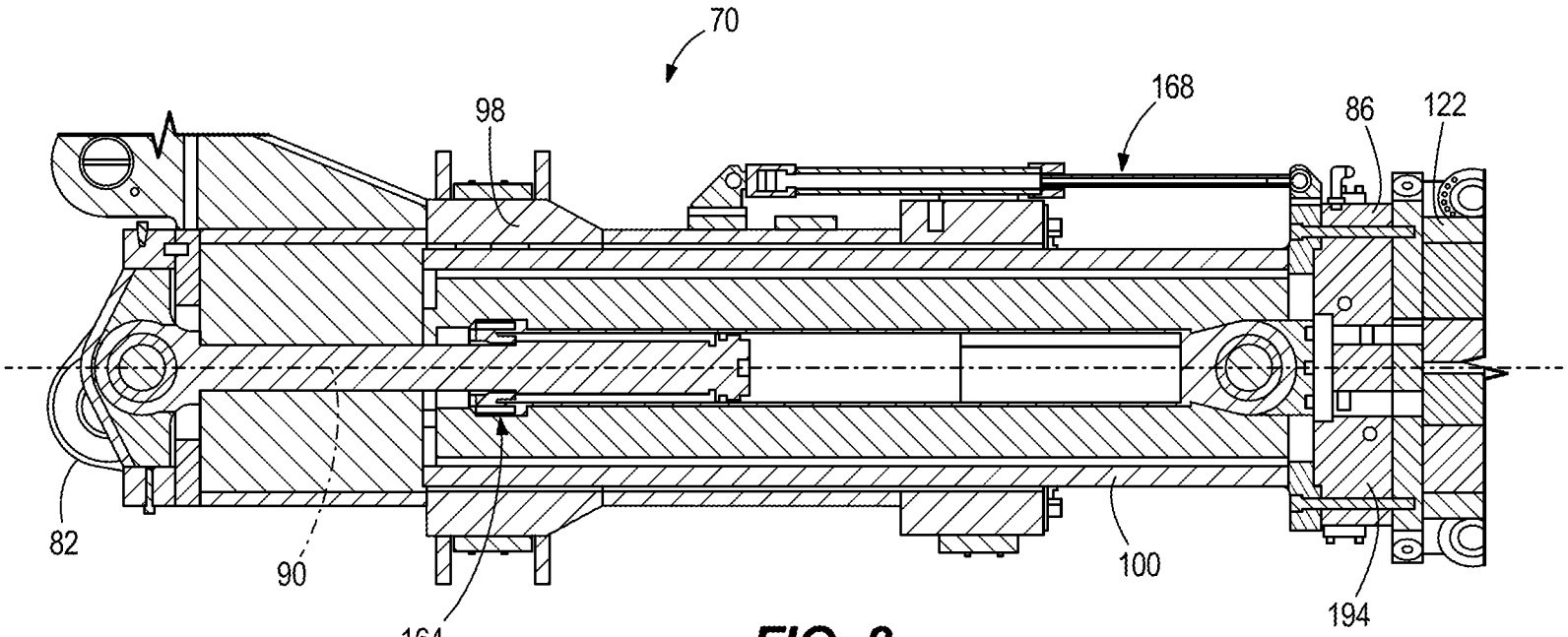
FIG. 8 is a section view of the boom of FIG. 3 viewed along section 8-8.

Referring now to FIG. 8, the first member 122 of the wrist portion 74 is coupled to the movable structure 100 of the base portion 70. In the illustrated embodiment, a fluid manifold 194 (e.g., a sandwich manifold) is positioned between the movable structure 100 and the first member 122, and a linear actuator 164 (e.g., a hydraulic piston-cylinder device) is positioned within the base portion 70. One end (e.g., a rod end) of the linear actuator 164 may be connected to the first structure 98, and another end (e.g., a cylinder end) of the actuator 164 may be connected to the manifold 194. The linear actuator 164 may have cylinder chambers in fluid communication with the manifold 194. Extension of the linear actuator 164 causes extension of the movable structure 100 in a direction parallel to the boom axis 90, and retraction of the linear actuator 164 causes retraction of the movable structure 100 in a direction parallel to the boom axis 90. In the illustrated embodiment, a sensor 168 is coupled between an outer surface of the first structure 98 and the manifold 194. The sensor 168 may include a transducer for measuring the stroke or position of the linear actuator 164 and the movable structure 100.

Figure 9:
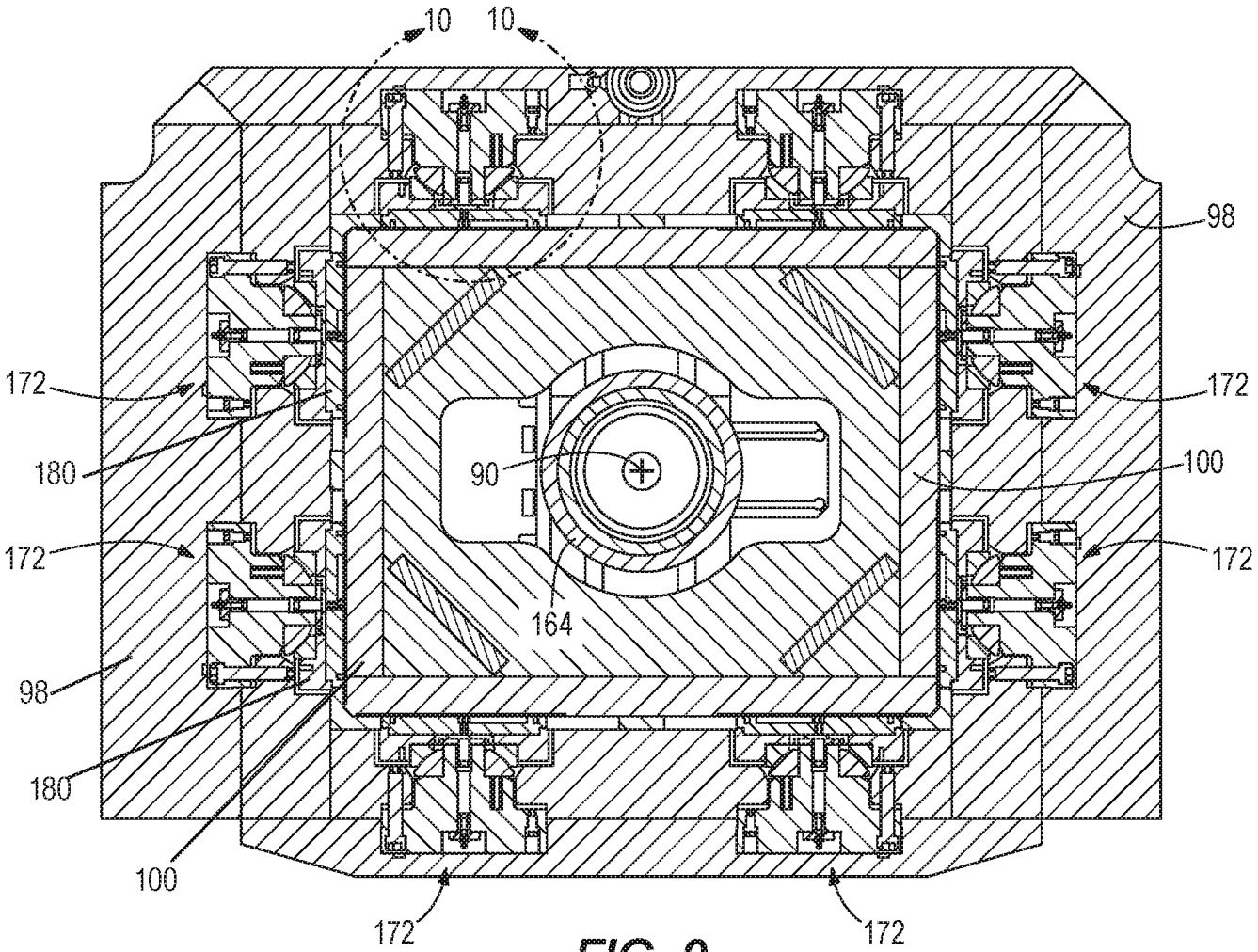
FIG. 9 is a section view of the boom of FIG. 3 viewed along section 9-9.

As best shown in FIG. 9, the movable structure 100 is supported relative to the first structure 98 by bearing assemblies 172. In the illustrated embodiment, eight bearing assemblies 172 are located in a common plane normal to the base axis 90, with two bearing assemblies 172 abutting each of the four sides of the movable structure 100. An additional set of eight bearing assemblies may be positioned in a similar manner in a second plane normal to the base axis 90 and offset from the plane illustrated in FIG. 9. In other embodiments, the base portion 70 may include fewer or more bearing assemblies 172, and the bearing assemblies 172 may be positioned in multiple planes along the length of the base axis 90. The bearing assemblies 172 may be positioned in a different manner.

Figure 10:
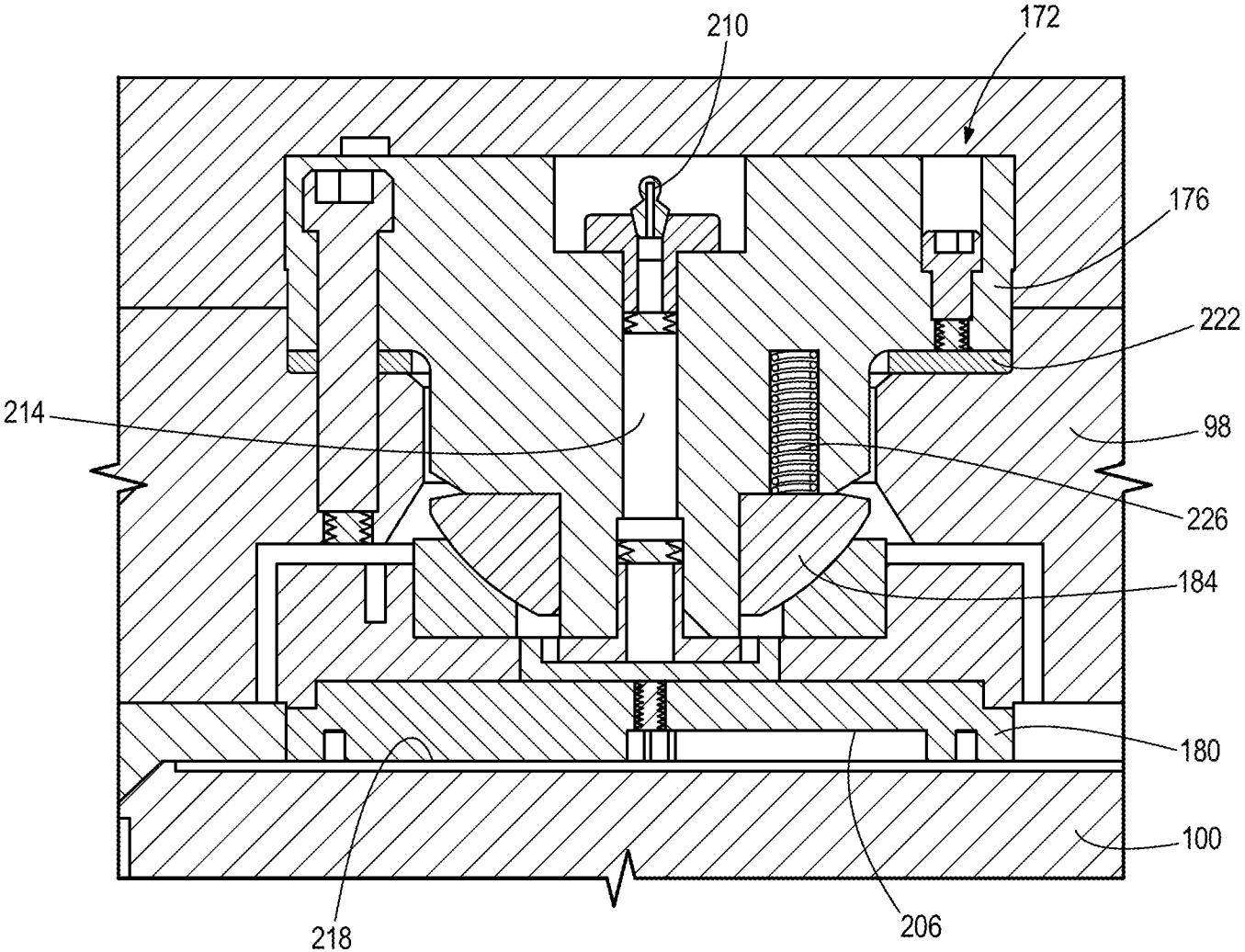
FIG. 10 is an enlarged view of portion 10-10 of the cross-section of FIG. 9.

As shown in FIG. 10, each bearing assembly 172 includes a main support 176 secured to the base portion 70 and a pad 180 abutting a surface of the movable structure 100. In addition a spherical bearing member 184 is coupled to the main support 176 to permit pivoting movement of the pad 180 relative to the main support 176. The pad 180 includes one or more pockets or chambers or galleries 206 formed in a surface of the pad 180 adjacent the movable structure 100. The main support 176 includes a port 210 and a passage 214 providing communication between the port 210 and galleries 206. The port 210 may receive a lubricant (e.g. grease) through a manual feed or an automatic lubrication system, and the lubricant may be transferred to the galleries 206 to lubricate the interface between the pad 180 and the movable structure 100. In addition, in the illustrated embodiment, a hard, low-friction bearing surface 218 is secured to an outer surface of the movable structure 100. The bearing surface 218 may be removably secured to the movable structure 100 (e.g., by fasteners) or attached by fusion (e.g., welding). The bearing assemblies 172 provide a low-friction interface and are capable of transmitting large forces caused by the cutting operation.

In addition, a shim pack 222 may be positioned between the main support 176 and the first structure 98 to adjust the position of the main support 176. A spring pack 226 may be positioned between the main support 176 and the spherical bearing member 184 to provide an initial load or preload to ensure that the pad 180 maintains positive contact with the movable structure 100 during operation. In other embodiments, other types of bearing assemblies may be used.

Although various aspects have been described in detail with reference to certain embodiments, variations and modifications exist within the scope and spirit of one or more independent aspects as described. Various features and advantages are set forth in the following claims.

What is claimed is:

1. A cutting assembly for a rock excavation machine including a frame, the cutting assembly comprising:

a boom including a first portion and a movable portion, the first portion supported for pivotable movement relative to the frame, the first portion extending along a longitudinal base axis, the movable portion coupled to the first portion and moveable relative to the first portion in a direction parallel to the longitudinal base axis;

at least one bearing supporting the movable portion for movement relative to the first portion, each bearing including a main support and a pad, the main support secured to the first portion, the pad abutting a surface of the movable portion, each bearing including a biasing member for biasing the pad against the surface of the movable portion; and a cutting device supported proximate an end of the movable portion of the boom, wherein the each bearing includes a member having a spherical surface to permit pivoting movement of the pad relative to the main support.

2. The cutting assembly of claim 1, wherein the pad includes a pocket positioned adjacent the surface of the movable portion, the pocket receiving a lubricative medium to facilitate movement of the movable portion relative to the pad.

3. The cutting assembly of claim 2, wherein each bearing includes a passage in fluid communication with the pocket, the passage in fluid communication with an inlet port positioned proximate an outer surface of the first portion.

4. The cutting assembly of claim 1, further comprising a fluid actuator extending at least partially through an interior chamber of the first portion and the movable portion, the fluid actuator including a first end coupled to the first portion and a second end coupled to the movable portion, the fluid actuator operable to move the movable portion relative to the first portion.

5. The cutting assembly of claim 1, wherein the at least one bearing includes at least one bearing supporting each side of the movable portion.

6. The cutting assembly of claim 1, wherein the boom further includes a wrist portion pivotably coupled to the movable portion, the wrist portion including a universal joint supporting the cutting device for pivoting movement.

7. A cutting assembly for a rock excavation machine, the rock excavation machine including a frame, the cutting assembly comprising:

a boom including a first portion and a movable portion, the first portion supported for pivotable movement relative to the frame, the first portion including a first structure extending along a longitudinal base axis and a second structure moveable relative to the first structure in a direction parallel to the longitudinal base axis, the movable portion pivotably coupled to the first portion by a universal joint;

a suspension system including a plurality of biasing members coupled between the first portion and the movable portion;

at least one bearing supporting the movable portion for movement relative to the first portion, each bearing including a main support and a pad, the main support secured to the first portion, the pad abutting a surface of the movable portion; and a cutting device supported by the movable portion of the boom.

8. The cutting assembly of claim 7, wherein the universal joint includes a first shaft coupled to the first portion and extending along a first axis, the universal joint further including a second shaft coupled to the movable portion and extending along a second axis, the second shaft pivotably coupled to the first shaft to permit pivoting movement of the movable portion relative to the first portion about the first axis and about the second axis.

9. The cutting assembly of claim 7, wherein the cutting device includes a cutting disc having a cutting edge positioned in a cutting plane, the cutting plane oriented in a direction substantially perpendicular to a longitudinal axis of the movable portion of the boom.

10. The cutting assembly of claim 7, wherein the cutting device includes a cutting disc and an excitation device, the excitation device including an eccentric mass supported for rotation in an eccentric manner and positioned proximate the cutting disc, wherein rotation of the eccentric mass induces oscillation of the cutting device.

11. The cutting assembly of claim 7, wherein the each bearing includes a member having a spherical surface to permit pivoting movement of the pad relative to the main support.

* * * * *